United States Patent [19]

Eftefield et al.

[11] 4,397,173

[45] Aug. 9, 1983

[54] TUBE EXPANDER

[75] Inventors: Larry G. Eftefield, Edelstein; Edward R. Horton, Dunlap, both of Ill.

[73] Assignee: Caterpillar Tractor Co., Peoria, Ill.

[21] Appl. No.: 277,746

[22] PCT Filed: Mar. 3, 1981

[86] PCT No.: PCT/US81/00276

§ 371 Date: Mar. 3, 1981

§ 102(e) Date: Mar. 3, 1981

[87] PCT Pub. No.: WO82/03037

PCT Pub. Date: Sep. 16, 1982

[51] Int. Cl.[3] ..... B21D 41/02; B23P 11/00

[52] U.S. Cl. ..... 72/392; 72/293; 72/370; 29/252; 29/283.5; 29/523

[58] Field of Search ..... 72/316, 318, 293, 370, 72/392, 408; 29/252, 256, 258, 244, 282, 283.5, 523, 507, 157.4

[56] References Cited

U.S. PATENT DOCUMENTS

| | | | |
|---|---|---|---|
| 586,438 | 7/1897 | Inshaw | 29/523 |
| 1,033,687 | 7/1912 | Fish | 72/392 |
| 1,867,288 | 7/1932 | Thomas | 413/27 |
| 2,275,451 | 3/1942 | Maxwell | 29/523 |
| 2,780,122 | 2/1957 | McCown | 81/444 |
| 3,369,287 | 2/1968 | Brochetti | 29/252 |
| 3,512,240 | 5/1970 | Robinson | 29/523 |
| 3,723,043 | 3/1973 | Leopold et al. | 29/523 |
| 3,758,938 | 9/1973 | Simmons et al. | 29/283.5 |
| 4,027,522 | 6/1977 | Clavin | 72/392 |

FOREIGN PATENT DOCUMENTS

| | | | |
|---|---|---|---|
| 788150 | 12/1957 | United Kingdom | 72/370 |

*Primary Examiner*—Daniel C. Crane
*Attorney, Agent, or Firm*—Robert A. McFall

[57] ABSTRACT

A tube expander (10), for extrudably expanding the walls of a tube (12) is disclosed.

The clamping force required on a tube (12) to prevent relative movement between the tube (12) and a tube expander (10), generally limits the amount of deformation completed during single stroke forming operations. The present invention provides a tube expander (10) for partially forming the tube (12) during insertion of the expander (10) into the tube (12) and fully forming the tube (12) during withdrawal of the expander (10). The tube expander (10) has an annular forming member (44) moveably mounted on a mandrel (22) for movement between a first position at which a plane (46) of the annular forming member (44) is at a skew angle with respect to a longitudinal axis (32) of the mandrel (22) and a second position at which the plane (46) of the annular forming member (44) is normal to the longitudinal axis (32).

The present invention is particularly useful for extrudably expanding the walls of a tube (12) into a plurality of circumferential grooves (17) disposed in a bore (14) of a flange (16).

4 Claims, 5 Drawing Figures

TUBE EXPANDER

DESCRIPTION

Technical Field

This invention relates generally to a tube expander for extrudably expanding the walls of a tubular member into the bore of a flange, and more particularly to such a tube expander having an annular forming member moveably mounted on a mandrel.

Background Art

Devices for expanding tubular members are well known in the industry. Generally, such devices employ a plurality of forming members expandably mounted on a tapered mandrel. After clamping and insertion into a tube, the forming members are radially extended to a predetermined diameter, and the tube is expanded to a requisite dimension in a single, unidirectional stroke as the tool is withdrawn. In addition to various expandable member forming devices, solid punches are used to extrudably form the walls of tube in a single, unidirectional stroke as the punch enters the workpiece.

It is necessary that the tube be securely clamped or otherwise restrained during deformation to prevent slippage of the tube with respect to the expander. In particular, in punch forming the amount of clamping force applied to the tube must be limited to avoid crushing, marring, or otherwise damaging the tube or tube surface. The single stroke forming actions of the above-described prior art devices are therefore inherently limited in that the axial forces applied during the single deformation stroke must not exceed the clamping forces on the tube, which in turn, must not be so great, that the tube will be damaged, as set forth above.

The present invention provides a tube expander that is not limited to forming during a single stroke and is directed to overcoming one or more of the problems as set forth above.

Disclosure of the Invention

In accordance with one aspect of the present invention, a tube expander for extrudably expanding the walls of a tube includes an annular forming member moveably disposed on a mandrel. The annular forming member has a generally circular cross section and is moveable between a first position at which the annular forming member is at a skew angle with respect to the longitudinal axis of the mandrel and a second position at which the forming member is normal to the longitudinal axis of the mandrel.

Current tube expanders, by their construction, are generally limited to forming a tube during a single stroke. For example, a solid punch type expander will extrude the wall of the tube as the punch enters the tube. An expanding element forming tool, such as a rotary expander, extrudes the tube wall as a mandrel of the tool rotates and is drawn into the tube. Both of these constructions are limited by the magnitude of the non-destructive clamping force which are available to resist the axial component of the extrusion forces.

The present invention provides a tube expander for partially forming the tube during insertion of the expander into the tube and fully forming the remainder during withdrawal of the expander. Preferably, about 50% of the tube is formed during the insertion operation. By dividing the tube deformation into two strokes of the expander, insertion and withdrawal, the clamping forces required for a given total amount of tube deformation are greatly reduced. The resultant reduced clamping requirements greatly reduce the possibility of structural and surface damage to the tubes.

BEST MODE FOR CARRYING OUT THE INVENTION

Figure 1:
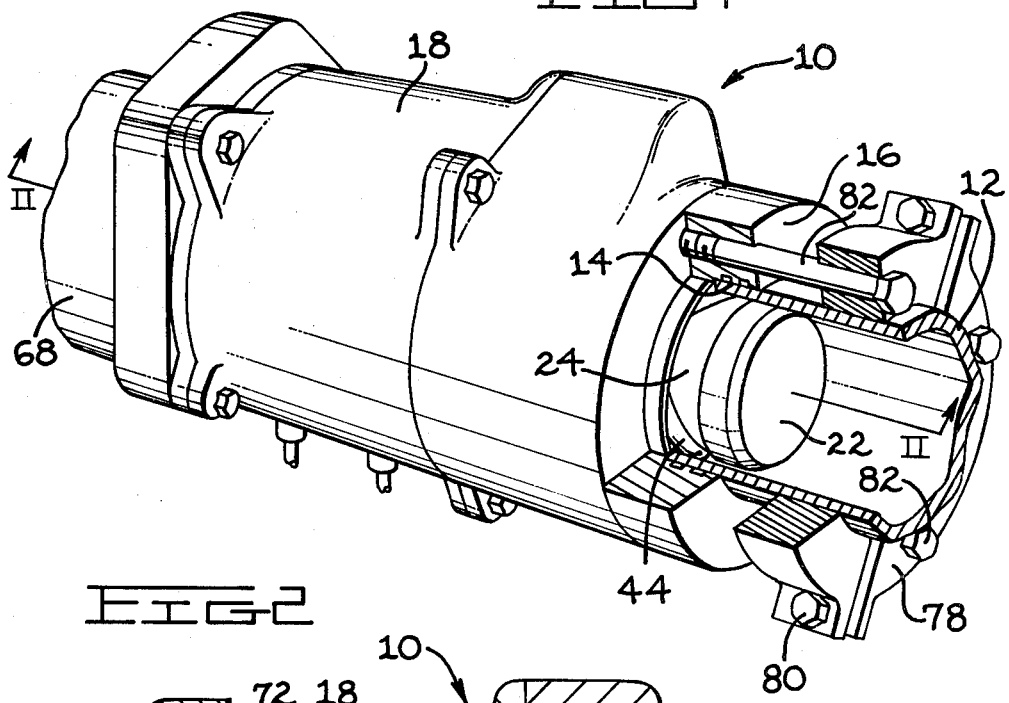
FIG. 1 is an isometric view of an embodiment of the present invention with portions broken away to show details of the assembly.
Figure 2:
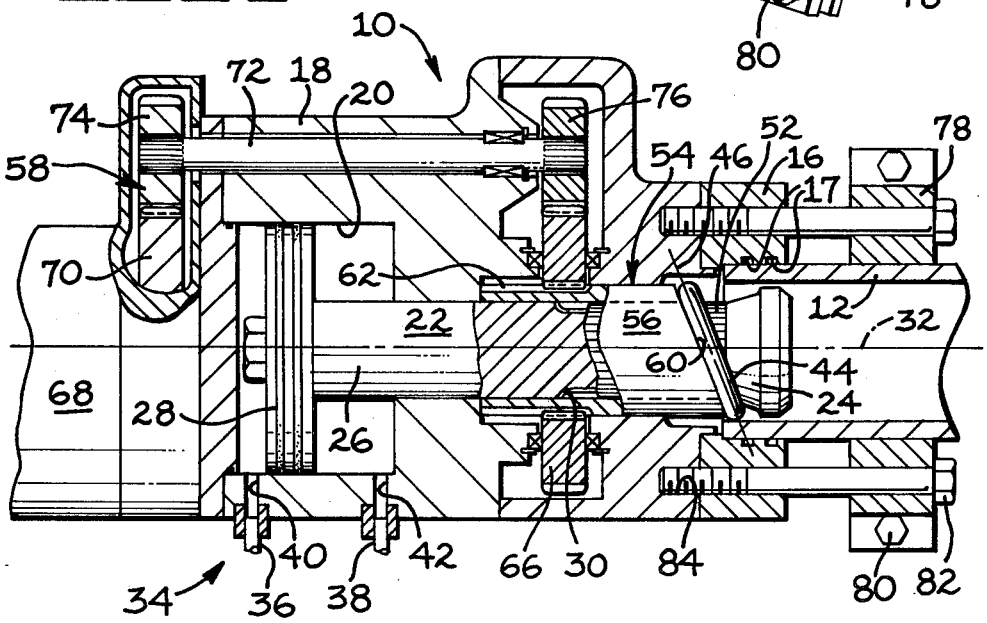
FIG. 2 is a partial longitudinal section of an embodiment of the present invention with the mandrel disposed in a contracted position substantially within the housing.

Referring to FIGS. 1 and 2, a tube expander 10 for extrudably expanding the walls of a tublular member, or tube, 12 into a bore 14 of a flange 16 having a plurality of circumferential grooves 17 formed in the bore 14 includes a housing 18 having a centrally disposed chamber 20, and a mandrel 22 partially disposed within the housing 18. The mandrel 22 has a frustoconically-shaped first end portion 24, a second end 26 having a piston portion 28 enclosed within the chamber 20 of the housing 18, a stepped shoulder 30 intermediately formed between the first end portion 24 and the second end 26, and a centrally disposed longitudinal axis 32.

Figure 3:
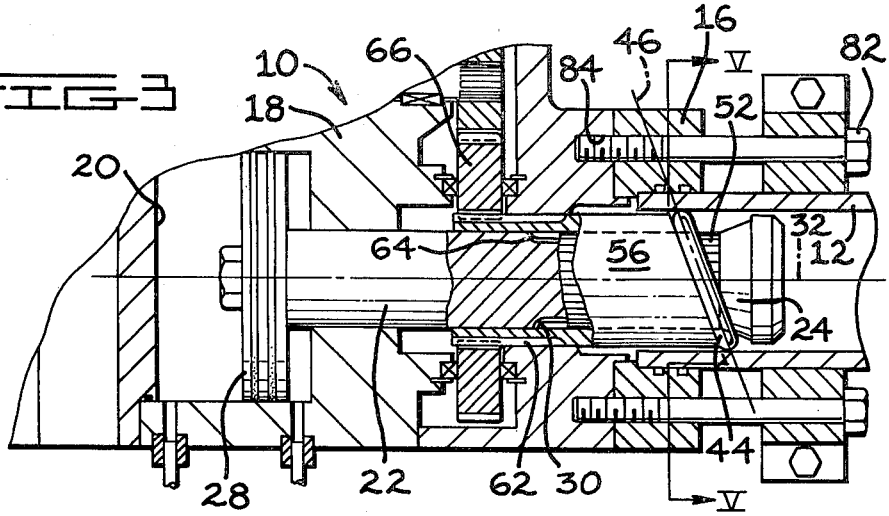
FIG. 3 is a partial longitudinal section of an embodiment of the present invention with the mandrel disposed at an extended position.
Figure 4:
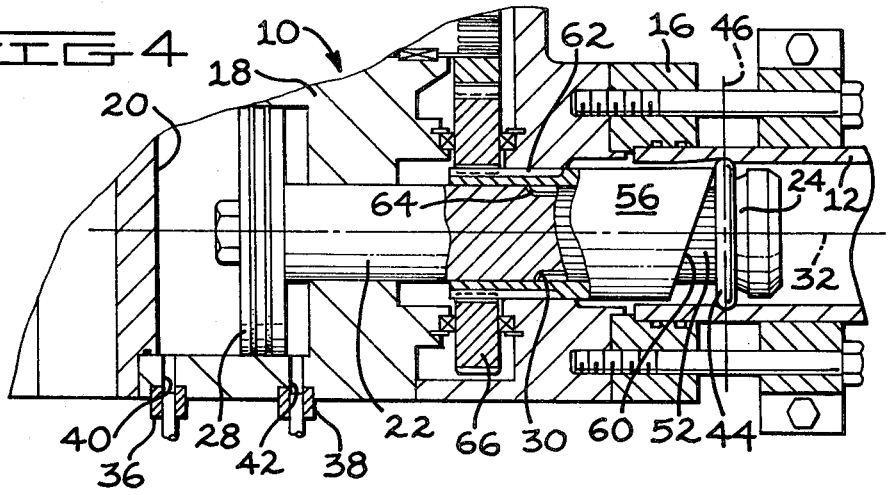
FIG. 4 is a partial longitudinal section of an embodiment of the present invention with the mandrel extended and the annular forming member positioned normal to the longitudinal axis of the mandrel.

A first means 34 is provided for moving the mandrel 22 in the direction of the longitudinal axis 32 between a contracted position at which the first end portion 24 is at a position substantially adjacent the housing 18, as shown in FIGS. 1 and 2, and an extended position at which the first end portion 24 is spaced from the housing 18 as shown in FIGS. 3 and 4. The first means 34 includes a source of pressurized fluid, such as a hydraulic pump, delivered to the housing 18 by a pair of hydraulic conduits 36,38. A pair of selectively pressurizable ports 40,42 in the housing 18 are in communication with the chamber 20 and the conduits 36,38, and are selectively pressurized by a conventional directional flow control valve, not shown, connected between the lines 36,38 and the source of pressurized fluid.

The tube expander 10 also includes an annular forming member 44 having a generally circular cross section. A plane 46, as shown in FIGS. 2, 3, and 4, passes through the coplanar annular axis of the forming member 44. The forming member 44 is slideably mounted on the mandrel 22 and is moveable between a first position, shown in FIGS. 1, 2, and 3, at which the plane 46 of the forming member 44 is at a skew angle with respect to the longitudinal axis 32 of the mandrel 22, and a second position shown in FIG. 4 at which the plane 46 of the forming member 44 is normal to the longitudinal axis 32 of the mandrel 22. When the forming member 44 is at the first position it will appear to be vertically foreshortened when viewed from a plane normal to the longitudinal axis 32, as represented by the sectional view of FIG. 5. When disposed at a skew angle, the annular forming member 44 appears as an ellipse having a major axis 48 in a horizontal direction, as viewed in FIG. 5, and a minor axis 50 in the vertical direction. When disposed at the first, or skewed position, the major axis 48 of the forming member 44 is identical with the normal radius of the forming member, and the radius of the minor axis is less than the normal radius.

Figure 5:
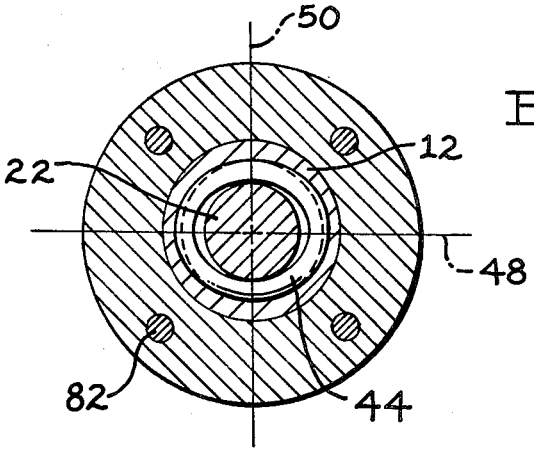
FIG. 5 is a cross section of an embodiment of the present invention taken along the lines V—V of FIG. 3 with a portion of the sleeve member removed to better show the annular forming member.

As best shown in FIG. 5, a portion of the forming member 44, at the normal radius, is in forming contact with the side walls of the tube 12 and another portion, and the foreshortened radius is spaced from the top and bottom walls of the tube 12. As may be easily discerned, the amount of clearance between the forming member 44 and the tube 12 at the top and bottom portions of the walls is a function of the skew angle formed between the annular forming member 44 and the longitudinal axis 32 of the mandrel 22.

In the embodiment shown, the forming member 44 has a circular cross section. Depending upon the material of the tube 12, the thickness of the tube walls, and the amount of deformation required, it may be desirable for the forming member 44 to have a non-circular cross section. For example, the forming member 44 may have a section with a surface shaped similarly to a conventional punch forming surface having a lead angle, i.e. the angle of increasing taper from front to back, of about 10° to 20°.

A second means 54 is provided for moving the annular forming member 44 from the first, skewed position to the second, normal position. The second means 54 includes a cylindrical sleeve member 56 rotatably mounted on the mandrel 22 and a third means 58 for rotating the sleeve member. The sleeve member 56 has a sloped end 60 that is constructed at a predetermined angle to support the annular forming member 44 at a corresponding predetermined skew angle, a second end having an externally disposed elongated gear 62, and a stepped bore defining a shoulder 64 mating with the stepped shoulder 30 of the mandrel 22.

The third means 58 includes a sleeve gear 66 slidably connected to the sleeve member 56, a high-torque gear motor 68 having a drive gear 70, a drive train 72 having a first pinion gear 74 mating with the drive gear 70 and a second pinion gear 76 mating with the sleeve gear 66. As shown in FIGS. 2, 3, and 4, the sleeve gear 66 circumferentially engages the elongated gear 62 of the sleeve member 56 permitting axial translation of the sleeve member 56 with respect to the sleeve gear 66. It is also preferable for the motor 68 to have a conventional stepping control, not shown, to rotate the sleeve member 56 through an arc of at least 180°.

A two-piece, split clamp 78 is placed around the tube 12 and secured in place by a pair of bolts 80. The tube expander 10 is clamped to the tube 12 by attachment to the split clamp 78. A plurality of bolts 82 extend through the clamp 78, and mounting holes provided in the flange 16, and engage threaded holes 84 provided in the housing 18.

INDUSTRIAL APPLICABILITY

It is desirable to expand the tube 12 into the bore 14 of the flange 16 sufficiently to substantially fill the circumferential grooves 17. The operation is, therefore, a cold extrusion process in which the metal flow is predominately in a radial direction. In the tube and associated flange embodiment shown, the end of the tube 12 abuts a radial wall of the flange 16. The abutment aids in positioning the tube 12 with respect to the flange 16 and provides for restraint of the tube during forming as a forming tool is withdrawn. Consequently, in this embodiment it is desirable to form at least 50% of the tube wall during withdrawal of the expander 10 from the tube 12.

The tube expander 10 of the present invention is placed in operation by inserting the mandrel 22 into the bore defined by the walls of the tube 12. At this position, the annular forming member 44 is supported on the mandrel 22 at a first position, shown in FIGS. 1 and 2, at which the plane 46 of the forming member 44 is at a skew angle with respect to the longitudinal axis 32 of the mandrel 22. The clamp 78 is secured to the tube 12 at a position spaced from the end of the tube 12 and the flange 16 is located on the tube end. The tube expander 10 is positioned in an abutting relationship with the flange 16 and secured in this position by threading the bolts 82 through holes provided in the clamp 78 and flange 16 and into the threaded holes 84 formed in the housing 18. It should be noted that if holes are not provided in the flange 16, it may be necessary to modify the clamping arrangement by moving the bolts 84 radially outwardly to clear the flange 16.

After securing the tube expander 10 to the tube and flange assembly, hydraulic fluid is directed through the conduit 36 and the associated port 40 and into the chamber 20. The port 42 is opened to permit a flow of fluid to an unpressurized reservoir or sump and the piston portion 28 is urged to the right, as viewed in the drawings, moving the mandrel 22 and the sleeve member 56 from the contracted position of FIG. 2 and to the extended position a predetermined distance into the bore of the tube 12 as shown in FIG. 3.

In the preceding translation of the mandrel 22 from the contracted position to the extended position, the annular forming member 44 is disposed at a skew angle on the mandrel 22 and thereby controllably expands only a preselected portion of the wall of the tube 12 in response to moving the annular forming member 44 from the end of the tube 12 to the predetermined position within the tube. As viewed in FIG. 5, the side portions of the tube 12 are expanded during the preceding first partial forming operation.

To reduce the clamping force required during the first partial forming operation it is desirable to divide the amount of tube expansion between this step and a subsequent forming step at which the remainder of the tube expansion is completed. Due to the restraint provided by the radial wall on the flange 16, and therefore lowering the clamping force required for forming during withdrawal of the expander 10, it is desirable to extrudably expand no more than 50% of the tube 12 during entry of the forming member 44 into the tube 12 and at least 50% during withdrawal of the forming member 44 from the tube 12. As mentioned above, the amount of clearance between the skewed forming member 44 and the top and bottom of the tube 12 and, conversely, the amount of forming of the side walls, is a function of the skew angle of the forming member 44 with respect to the longitudinal axis 32 of the mandrel 22. For example, in a nominal 0.051 m (2.00 in.), tube 12 having an internal preformed diameter of 0.0412 m (1.624 in.), and where it is desired to expand the preformed diameter to 0.0431 m (1.696 in.) to radially extrude the walls into the grooves 17 of the flange 16, a skew angle of approximately 20°, that is the plane 46 of the annular forming member 44 is at an angle 20° with respect to the normal of the longitudinal axis 32 of the mandrel 22, will expand approximately 49% of the wall during movement of the forming member 44 into the tube 12.

After movement to the predetermined position into the tube 12, the motor 68 is actuated to rotate the sleeve member 56 about an arc of at least 180° to move the annular forming member 44 from the first, skewed position to a second position, shown in FIG. 4, at which the plane 46 of forming member 44 is normal with respect to the longitudinal axis 32 of the mandrel 22. At the second position, the forming member is supported on the frustoconically-shaped first end portion 24 of the mandrel 22.

Either during, or immediately, after rotation of the forming member 44 to the second position, the port 40 is opened and pressurized fluid is directed through the conduit 38 to the port 42, and into the chamber 20, for urging the piston portion 24 of the mandrel 22 to the left. As a result, the mandrel 22 is moved from the extended position to the contracted position. During the withdrawal of the mandrel 22 from the tube 12, the plane 46 of the annular forming member 44 is normal to longitudinal axis 32 of the mandrel 22 and the remaining unexpanded portion of the walls of the tube 12 is controllably deformed.

Other aspects, objects and advantages of this invention can be obtained from a study of the drawings, the disclosure and the appended claims.

What is claimed is:

1. In a tube expander (10) for extrudably expanding the walls of a tubular member (12) into the bore (14) of a flange (16), said tube expander (10) having a housing (18), a mandrel (22) having a first end portion (24) and longitudinal axis (32) and being at least partially disposed within said housing (18), and a first means (34) for moving said mandrel (22) along said longitudinal axis (32), the improvement comprising:

an annular forming member (44) having a generally circular cross section, being slideably mounted on said mandrel (22), and being moveable between a first position at which the forming member (44) is at a skew angle with respect to the longitudinal axis (32) of said mandrel (22) and a second position at which said forming member (44) is normal to the longitudinal axis (32) of said mandrel (22);

a second means (54) for moving said annular forming member (44) from said first position to said second position, said second means (54) having a sleeve member (56) rotatably mounted on said mandrel (22); and, a third means (58) for rotating said sleeve member (56), said third means including a sleeve gear (66) slidably connected to said sleeve member (56), a motor (68) having a drive gear (70), and a drive train (72) having a first gear (74) mating with said drive gear (70) and a second gear (76) mating with said sleeve gear (66).

2. The tube expander (10), as set forth in claim 1, wherein said housing (18), includes a centrally disposed cylindrical chamber (20), said mandrel (22) includes a piston portion (28) formed at a second end (26) of said mandrel (22), said piston portion (28) being enclosed within said cylindrical chamber (20), and said first means (34) includes a source of pressurized fluid and a pair of selectively pressurizable ports (40,42) in said housing (18) communicating said chamber (20) with said source of pressurized fluid.

3. A tube expander (10), comprising:

a housing (18);

a mandrel (22) having a first end portion (24) and a longitudinal axis (32);

first means (34) for moving said mandrel (22) between a contracted position at which the first end portion (24) of said mandrel (22) is at a position substantially adjacent said housing (18) and an extended position at which the first end portion (24) of said mandrel (22) is spaced from said housing (18);

an annular forming member (44) having a generally circular cross section and being slideably mounted on said mandrel (22) and being moveable between a first position at which a plane (46) of the forming member (44) is at a skew angle with respect to the longitudinal axis (32) of said mandrel (22) and a second position at which the plane (46) of said forming member (44) is normal to the longitudinal axis (32) of said mandrel (22);

a second means (54) for moving said annular forming member (44) from said first position to said second position, said second means (54) having a sleeve member (56) rotatably mounted on said mandrel (22); and, a third means (58) for rotating said sleeve member (56), including a sleeve gear (66) circumferentially engaging said sleeve member (56), a motor (68) having a drive gear (70), and a drive train (72) having a first pinion gear (74) mating with said drive gear (70) and a second pinion gear (76) mating with said sleeve gear (66).

4. The tube expander (10), as set forth in claim 3, wherein said housing (18) includes a centrally disposed cylindrical chamber (20), said mandrel (22) includes a piston portion (28) formed at a second end (26) of said mandrel (22), said piston portion (28) being enclosed within said cylindrical chamber (20), and said first means (34) includes a source of pressurized fluid and a pair of selectively pressurizable ports (40,42) in said housing (18) communicating said chamber (20) with said source of pressurized fluid.

* * * * *